United States Patent [19]

Davies et al.

[11] Patent Number: 4,938,849

[45] Date of Patent: Jul. 3, 1990

[54] ELECTROCHEMICAL PROCESS FOR PRODUCING SATURATED OR UNSATURATED FLUOROCARBONS

[75] Inventors: Gwilym R. Davies, Via Warrington; Guy Q. Maling, Malpas, both of England

[73] Assignee: Imperial Chemical Industries Plc, London, United Kingdom

[21] Appl. No.: 434,640

[22] Filed: Nov. 9, 1989

Related U.S. Application Data

[63] Continuation of Ser. No. 201,862, Jun. 1, 1988, abandoned.

[30] Foreign Application Priority Data

Jun. 3, 1987 [GB] United Kingdom ..... 8712989

[51] Int. Cl.[5] ..... C25B 3/00

[52] U.S. Cl. ..... 204/73 R; 204/78; 204/79; 204/80; 204/59 F

[58] Field of Search ..... 204/73 R, 78, 79, 80, 204/59 F

[56] References Cited

U.S. PATENT DOCUMENTS

| | | | |
|---|---|---|---|
| 4,162,948 | 7/1979 | Yagii et al. | 204/72 |
| 4,800,012 | 1/1989 | Dapperheld et al. | 204/73 R |

FOREIGN PATENT DOCUMENTS

| | | |
|---|---|---|
| 0023077 | 1/1981 | European Pat. Off. . |
| 852487 | 10/1968 | Italy . |
| 230131 | 10/1974 | U.S.S.R. . |
| 702702 | 9/1983 | U.S.S.R. . |

OTHER PUBLICATIONS

"Continuous Electrochemical Preparation of Chlorotrifluoroethylene", J. Electrochem. Soc., vol. 124, No. 6, pp. 860–861 (1977).

*Primary Examiner*—John F. Niebling
*Assistant Examiner*—Steven P. Marquis
*Attorney, Agent, or Firm*—Cushman, Darby & Cushman

[57] ABSTRACT

A saturated or unsaturated fluorocarbon is produced by electrolytic reduction of a saturated fluorocarbon containing at least on atom of chlorine or bromine in an electrolytic cell having a low hydrogen overpotential cathode. The cathode is preferably stainless steel, and the fluorocarbon which is produced is preferably a fluorohydrocarbon.

23 Claims, No Drawings

ELECTROCHEMICAL PROCESS FOR PRODUCING SATURATED OR UNSATURATED FLUOROCARBONS

This is a continuation of application Ser. No. 07/201,862, filed June 1, 1988, which was abandoned upon the filing hereof.

This invention relates to an electrochemical process and more particularly to an electrochemical process for the production of fluorohydrocarbons.

Italian patent No. 852487 describes a process for the production of unsaturated chlorofluoro - or fluorocarbons and/or saturated chlorofluoro or fluorohydrocarbons by electrolytic reduction of saturated chlorofluorcarbons having the safe number of carbon atoms. In the process the saturated chlorofluorocarbon is dissolved in a solvent which also contains an electrolyte and the electrolytic reduction is effected in an electrolytic cell consisting of two electrodes. The electrolytic cell may be undivided or it may comprise a porous separator. The cathode in the electrolytic cell is mercury, indeed mercury is the only material specially described as being suitable for use as a cathode. The use of mercury as a cathode at which to effect the reduction is not surprising as mercury has the highest overpotential known for the electrolytic production of hydrogen. However, mercury is not the most convenient material to use as a cathode as it is liquid. Also, in the process of the Italian patent the reduction is effected at a very low current density.

It has been found, surprisingly, that it is possible to effect electrolytic reduction of chloro-or bromo fluorocarbons in an electrolytic cell which is equipped with a cathode constructed of a material of low hydrogen overpotential, and that the reduction may be effected at a high current density. Even though a material having a low overpotential for the production of hydrogen is used as the cathode the reduction process is favoured over the production of hydrogen.

USSR Patent No. 230 131 describes a process for the preparation of fluoroolefines by dehalogenation of freons in which, with the aim of increasing the yield of the desired product and improving its purity, the dehalogenation of the freons is performed electrochemically in an electrolytic cell in neutral or alkaline medium in the presence of an organic solvent with the addition to the catholyte of soluble compounds of metals, for example lead. In the process the favoured material for use as the cathode in the electrolytic cell is lead. We find that lead when used as a cathode in such a process readily corrodes. Furthermore, lead has a high overpotential for the production of hydrogen.

USSR Patent No. 702 702 describes a process for the production of 1,1,2-trifluorochloroethylene by electrochemical dechlorination of 1,1,2-trifluorotrichloroethane in the presence of an electrolyte which is a soluble salt of a metal in neutral or weakly alkaline medium using a metallic cathode in which, with the aim of improving the yield of the desired product, simplifying, intensifying and rendering the process continuous, a porous hydrophobised metal is used as the metallic cathode, the starting 1,1,2-trifluorotrichloroethane being supplied to the cathode from its reverse side. In the patent the only materials which are described for use as the cathode in the electrolytic cell are zinc and cadmium both of which have a high overpotential for the production of hydrogen.

According to the present invention there is provided a process for the production of a saturated or unsaturated fluorocarbon by the electrolytic reduction of a saturated fluorocarbon containing at least one atom selected from chlorine and bromine, in which the reduction is effected in an electrolytic cell equipped with a cathode having a low overpotential for the production of hydrogen.

In the process the saturated fluorocarbon which is reduced may have the formula R-X in which R represents an alkyl group having at least one fluorine atom and X represents chlorine or bromine.

The fluorocarbon R-X may be reduced in the process to a saturated fluorohydrocarbon R-H, or it may be reduced to an unsaturated fluorocarbon. Whether or not a saturated fluorohydrocarbon or an unsaturated fluorocarbon is produced in the electrolytic reduction process depends to some extent on the structure of the saturated fluorocarbon which is reduced. For example, the alkyl group R in the saturated fluorocarbon R-X may itself contain one or more atoms selected from chlorine and bromine, and, where the group R contains two or more carbon atoms and one or more chlorine and/or bromine atoms, and the chlorine and/or bromine atoms which are present in the fluorocarbon R-X are present on the same carbon atom, the production of a saturated fluorohydrocarbon R-H maybe favoured, depending on certain other factors which will be referred to hereafter. On the other hand, where the group R contains two or more carbon atoms and one or more chlorine and/or bromine atoms, and the chlorine and/or bromine atoms in the fluorcarbon R-X are present on adjacent carbon atoms, the production of an unsaturated fluorocarbon by reductive dehalogenation may be favoured, depending once again on certain other factors which will be referred to hereafter.

The electrolytic reduction process is effected in an electrolytic cell containing at least one anode and at least one cathode. The design of the cell which is used to effect the process of the invention is not critical, except of course that the cathode must be a cathode as defined. For example, the electrolytic cell may be divided and comprise a separator positioned between each anode and adjacent cathode, or the cell may be undivided. Where a separator is present it may be a porous hydraulically permeable diaphragm or a substantially hydraulically impermeable ion-exchange membrane, e.g. a cation-exchange membrane. However, it is preferred to use an undivided electrolytic cell as the power costs are generally lower than in the case where the cell is a divided cell. In order to minimise power costs it is also preferred to operate the process with a small gap between each anode and adjacent cathode. The gap may be as small as 0.5 mm, which is generally the minimum practicable gap, particularly where electrodes having a substantial surface area are used. In general, the gap between each anode and adjacent cathode will not be greater than 5 mm.

The electrolytic cell may be of the monopolar type or of the bipolar type, and it may be equipped with means for circulation of the fluorocarbon through the electrolytic cell.

The anode may be made of any suitable material, and carbon is an example of such a material which is inexpensive. It is preferred that the anode is made of a material which is dimensionally stable under the conditions of the electrolytic process, and an example of such a material is a metal of the platinum group, e.g. platinum itself. Alternatively, the anode may comprise a substrate of a film-forming metal, e.g. of titanium or titanium alloy, coated with a metal of the platinum group.

The cathode in the electrolytic cell has a low overpotential for the production of hydrogen. Although we do not wish to be limited thereto the cathode may have an overpotential for the production of hydrogen of less than 0.8 volt at a current density of 1 kA $m^{-2}$ in 6N aqueous sodium hydroxide solution at 25° C. (See Comprehensive Treatise on Electrochemistry, Vol.2, chapt.2, page 128, Production of Chlorine). It is a surprising feature of the invention that even though a low hydrogen overpotential cathode is used the reduction process is favoured over the production of hydrogen. Suitable low hydrogen overpotential materials for the cathode include metals selected from titanium, nickel, aluminium, cobalt and silver and alloys of these metals, but it is much preferred, on account of low cost and ready availability, to use a cathode constructed of iron, particularly iron in the form of stainless steel. By way of contrast, some of the materials having a high over potential for the production of hydrogen are either toxic, for example mercury, lead and zinc, and/or are expensive, for example cadmium.

The anode and cathode of the electrolytic cell may have any suitable structure, for example, plane plate, perforated plate, woven or unwoven mesh, or expanded metal.

The saturated fluorocarbon containing at least one atom selected from chlorine and bromine is suitably subjected to electrolytic reduction in a liquid solvent in which the fluorocarbon is at least dispersible but in which it is preferably soluble. The solvent may be aprotic, that is not have labile hydrogen, and use of such a solvent favours the production of an unsaturated fluorocarbon rather than a saturated fluorohydrocarbon. Examples of aprotic solvents include acetonitrile, dichloromethane, dimethyl formamide, carbon tetrachloride, propylene carbonate, dimethyl sulphoxide, tetra hydrofuran and dioxane. On the other hand, the solvent may be a protic solvent having labile hydrogen, and use of such a solvent favours the production of a saturated fluorohydrocarbon rather than an unsaturated fluorocarbon. Examples of protic solvents include water, alcohols, e.g. methanol, ethanol, and phenols, and carboxylic acids, e.g. acetic acid. Particularly preferred are aqueous solutions of alcohols, e.g. of methanol, especially where production of a saturated fluorohydrocarbon is desired.

The solvent may comprise an electrolyte dissolved therein. Examples of suitable electrolytes include halides and hydroxides of alkali metals, e.g. sodium hydroxide and potassium hydroxide. Suitable concentrations of electrolyte may depend on the nature of the solvent. For example, where the solvent is an aprotic solvent the concentration of the electrolyte is suitably in the range 0.1 to 0.5M, whereas where the solvent is a protic solvent the concentration of electrolyte is suitably in the range of 0.1 to 3M, although these concentrations ranges are meant to be for guidance only.

Similarly, the concentration of the fluorocarbon which is reduced in the process of the invention may vary over a wide range, e.g. over a range of from 10% to 60% weight/volume.

The conditions under which the electrolytic cell may be operated may also vary over a wide range. Thus, the electrolytic reduction process may be effected at a current density as low as 0.2 kA $m^{-2}$ but it is preferred, in order to produce the saturated or unsaturated fluorcarbon at a reasonable rate, for the current density to be of the order of 2 $kAm^{-2}$, although even higher current densities may be used.

In general the electrolytic reduction process will be operated at constant current density and the voltage changed in order to maintain the constant current density. The voltage at which it is necessary to operate will generally vary between 4 volts and 15 volts.

The temperature at which the electrolytic reduction process is effected will be governed by the desire to maintain the fluorocarbon containing chlorine and/or bromine, and the saturated or unsaturated fluorocarbon which is produced in the electrolytic process, in a liquid state at the pressure at which the process is operated. The process may be operated at elevated pressure, e.g. at a pressure of up to 5 bar or even 10 bar or more, depending on the design of the electrolytic cell, and in general a temperature of between −15° C. and 50° C., or even 80° C., may be used.

The progress of the electrolytic reduction may be monitored by conventional analytical procedures, and the saturated or unsaturated fluorocarbon which is produced may be isolated in conventional manner.

Saturated fluorocarbons containing chlorine and/or bromine which may be reduced in the process of invention include substituted methanes, for example bromofluoromethane and substituted ethanes, for example 1,1,2-trichloro-1,2,2-trifluoroethane and compounds of the formula:

$$CF_3CC1YZ$$

wherein each of Y and Z, independently, represents hydrogen, chlorine or fluorine. Merely by way of example a saturated fluorocarbon having the formula $CF_3—CFCl_2$ may be reduced to the saturated fluorohydrocarbon $CF_3—CFClH$. On the other hand reduction of the isomeric saturated fluorocarbon $CF_2Cl—CF_2Cl$ may be by way of reductive dechlorination to yield the unsaturated fluorocarbon $CF_2{=}CF_2$.

Where the saturated fluorocarbon which is to be reduced is $CF_3—CFCl_2$ it may be the substantially pure compound or it may be used in the form of a commercially available mixture with $CF_2Cl—CF_2Cl$. Using such a mixture of isomers it is possible to convert the compound $CF_3CFCl_2$ to $CF_3CFClH$ in very high yield whilst leaving the compound $CF_2Cl—CF_2Cl$ virtually unchanged or at most converting a small amount to $CF_2{=}CF_2$. Suitable mixtures contain at least 1% and typically from 5 to 95% of the compound $CF_3CFCl_2$ on a weight basis. The method of the invention thus provides a convenient method for increasing the content of $CF_2Cl—CF_2Cl$ in a mixture of the isomers.

The invention is illustrated but not limited by the following examples.

EXAMPLE 1

Electrolysis was conducted in an undivided laboratory micropilot filter press cell which contained a flat plate platinum anode having an effective area of 30 $cm^2$ and a disked stainless steel 316 cathode having an effective area of 20 $cm^2$. The anode to cathode gap was 2 mm.

An electrolyte of 250 ml of a 1M solution of sodium hydroxide in aqueous methanol (90% by weight methanol and 10% by weight water) was mixed with 119 g of a 50:50 weight:weight mixture of dichlorotetrafluorethane isomers ($CF_2Cl—CF_2Cl$ and $CF_3—CFCl_2$). The mixture of electrolyte and dichlorotetrafluoroethane isomers was pumped into and was circulated through the cell at a flow rate of 2 $lmin^{-1}$ and electrolysis was effected at a cathode current density of 1 $kAm^{-2}$ and at a cell voltage of 6 to 7 volts, and the temperature of the cell was maintained at −2 to 4° C. Current efficiency for the production $CF_3—CFClH$ from $CF_3CFCl_2$ was 59% and the conversion of $CF_3—CFCl_2$ to $CF_3—CFClH$ was 40% by weight.

EXAMPLE 2

Electrolysis was effected in a electrolytic cell as described in Example 1. In this Example an electrolyte of 250 ml of a 2M solution of potassium hydroxide in aqueous methanol (95% by weight methanol and 5% by weight water) was mixed with 50 g of 1,1,1-trichloro-2,2,2-trifluoroethane ($CF_3—CCl_3$), and electrolysis was effected for four hours at a cathode current density of 1 $kAm^{-2}$, a cell voltage of 4.5 to 10 volts, a temperature of 15 to 17° C., and at a flow rate of 2 $lmin^{-1}$.

The conversion of $CF_3—CCl_3$ to $CF_3\ CCl_2H$ was 55% by weight.

EXAMPLE 3

Electrolysis was effected in an Eberson flow cell of concentric tube design and comprising an inner platinised titanium anode and an outer stainless steel 316 cathode having an effective area of 700 $cm^2$. The cell was undivided and the anode to cathode gap was 1 to 2 mm. The outer cylinder comprised entry and exit ports and the ends of the cylinder were sealed by Viton "O" rings. The cell was connected to a reservoir to which was charged an electrolyte of 12.1 l of a 2M solution of potassium hydroxide in aqueous methanol (99% by weight methanol and 1% by weight water) mixed with 3227 g of a 50:50 weight:weight mixture of dichlorotetrafluoroethane isomers ($CF_3Cl—CF_2Cl$ and $CF_3—CFCl_2$).

The mixture of electrolyte and dichlorotetrafluoroethane isomers was circulated through the cell at flow rate of 5 $lmin^{-1}$ and electrolysis was conducted for 24 hours at a cathode current density of 0.7 $kAm^{-2}$, a cell voltage of 6 volts, and a temperature of −24 to −8° C.

The composition of the product was as follows

| The composition of the product was as follows | |
|---|---|
| $CClF_2—CClF_2$ | 43% by weight |
| $CClF_2—CF_3$ | 17% by weight |
| $CHF_2—CClF_2$ | 4% by weight |
| $CHClF—CF_3$ | 36% by weight |

The current efficiency for the production of $CHClF—CF_3$ from $CClF_2—CF_3$ was 45.8% and the conversion of $CClF_2—CF_3$ to $CHClF—CF_3$ was 66% by weight.

EXAMPLE 4

The procedure of Example 1 was repeated except that the electrolytic cell contained a dished aluminium cathode, and the electrolyte, which comprised 250 ml of a 2M solution of potassium hydroxide in aqueous methanol (as used in Example 1), was mixed with 72 g of a 50:50 weight:weight mixture of $CF_2Cl—CF_2Cl$ and $CF_3—CFCl_2$. Electrolysis was effected for 110 minutes at a flow rate of 2 $lmin^{-1}$, a cathode current density of 0.5 to 1.1 $kAm^{-2}$, a cell voltage of 7 volts, and a temperature of −15 to 2° C.

$CF_3—CFHCl$ was produced from $CF_3—CFCl_2$ at a current efficiency of 55%.

EXAMPLE 5

The procedure of Example 1 was repeated except that the electrolyte, which comprised 500 ml of a 1M solution of potassium hydroxide in aqueous methanol (96.8% by weight methanol and 3.2% by weight water) was mixed with 50 g of a mixture of dichlorotetrafluoroethane isomers (62% by weight $CF_2Cl—CF_2Cl$ and 38% by weight $CF_3—CFCl_2$). Electrolysis was effected for 5 hours 20 minutes at a flow rate of 2 $lmin^{-1}$, a cathode current density of 1 $kAm^{-2}$, a cell voltage of 5.7 to 6 volts, and a temperature of −8° C. $CF_3—CHClF$ was produced from $CF_3—CFCl_2$ at a current efficiency of 42% and the conversion of $CF_3—CFCl_2$ to $CF_3—CHClF$ was 73% by weight. Tetrafluoroethylene was produced at a current efficiency of 11% and the conversion of $CF_2Cl—CF_2Cl$ to $CF_2{=}CF_2$ was 15%.

We claim:

1. A process for the production of a saturated or unsaturated fluorocarbon by direct electrolytic reduction of a saturated fluorocarbon containing at least one atom selected from chlorine and bromine, in which the reduction is effected in an electrolytic cell equipped with a cathode having low overpotential for the production of hydrogen and in which the reduction is effected at said cathode.

2. A process as claimed in claim 1 in which the saturated fluorocarbon which is reduced in the process has the formula R-X in which R represents an alkyl group having at least one fluorine atom and X represents chlorine or bromine.

3. A process as claimed in claim 2 in which the saturated fluorocarbon R-X is reduced to a saturated fluorohydrocarbon having the formula R-H.

4. A process as claimed in claim 2 in which the alkyl group R contains one or more atoms selected from chlorine and bromine.

5. A process as claimed claim 3 in which the group R contains two or more carbon atoms and in which the chlorine and/or bromine atoms which are present in the fluorocarbon are present on the same carbon atom.

6. A process as claimed in claim 4 in which the group R contains two or more carbon atoms and in which the chlorine and/or bromine atoms which are present in the fluorocarbon are on adjacent carbon atoms.

7. A process as claimed in claim 5 in which the saturated fluorocarbon which is reduced has the formula $CF_3—CFCl_2$ and the fluorocarbon which is produced has the formula $CF_3—CFClH$.

8. A process as claimed in claim 6 in which the saturated fluorocarbon which is reduced has the formula $CF_2Cl—CF_2Cl$ and the fluorocarbon which is produced has the formula $CF_2{=}CF_2$.

9. A process as claimed in claim 1 which is effected in an undivided electrolytic cell.

10. A process is claimed in claim 1 in which the cathode has an overpotential for the production of hydrogen of less than 0.8 volts at a current density of 1 $kAm^{-2}$ in 6N aqueous sodium hydroxide solution at 25° C.

11. A process as claimed in claim 10 in which the cathode is constructed of iron.

12. A process as claimed in claim 11 in which the cathode is constructed of stainless steel.

13. A process as claimed in claim 1 in which the saturated fluorocarbon which is reduced is dissolved in a solvent.

14. A process as claimed in claim 13 in which the solvent is in an aprotic solvent.

15. A process as claimed in claim 13 in which the solvent is a protic solvent.

16. A process as claimed in claim 13 in which an electrolyte is dissolved in the solvent.

17. A process as claimed in claim 16 in which the electrolyte comprises a halide or hydroxide of an alkali metal.

18. A process as claimed in claim 1 which is effected at a cathode current density of up to 4 $kAm^{-2}$.

19. A process as claimed in claim 16 in which the concentration of the electrolyte dissolved in the aprotic solvent is in the range 0.1 to 0.5M.

20. A process as claimed in claim 16 in which the concentration of the electrolyte dissolved in the aprotic solvent is in the range 0.1 to 3M.

21. A process as claimed in claim 13 in which the concentration of saturated fluorocarbon in the solvent is in the range 10% to 60% weight/volume.

22. A process as claimed in claim 13 in which the solvent comprises an aqueous solution of methanol and the electrolyte comprises sodium hydroxide and/or potassium hydroxide.

23. A saturated or unsaturated fluorocarbon produced by a process as claimed in claim 1.

* * * * *